US008727393B2

(12) United States Patent
Ruspil

(10) Patent No.: US 8,727,393 B2
(45) Date of Patent: May 20, 2014

(54) WINDOW LOCK

(75) Inventor: Mathew D. Ruspil, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 223 days.

(21) Appl. No.: 12/755,642

(22) Filed: Apr. 7, 2010

(65) Prior Publication Data

US 2010/0263415 A1 Oct. 21, 2010

Related U.S. Application Data

(60) Provisional application No. 61/169,826, filed on Apr. 16, 2009.

(51) Int. Cl.
*E05C 1/08* (2006.01)
*E05C 1/04* (2006.01)
*E05C 1/02* (2006.01)

(52) U.S. Cl.
USPC .... 292/163; 292/137; 292/146; 292/DIG. 20; 292/DIG. 47

(58) Field of Classification Search
USPC ..... 292/157, 137, DIG. 20, 163, 175, 145, 292/146, 153, DIG. 47, 164; 49/449, 176
See application file for complete search history.

(56) References Cited

U.S. PATENT DOCUMENTS 2,533,023 A * 12/1950 Lickteig ..... 292/169.15
2,621,951 A * 12/1952 Ostadal ..... 292/169.15
4,475,313 A * 10/1984 Governale ..... 49/370
4,837,975 A * 6/1989 Simpson ..... 49/175
5,028,083 A * 7/1991 Mischenko ..... 292/175
5,062,671 A * 11/1991 Goetz et al. ..... 292/175
5,553,903 A * 9/1996 Prete et al. ..... 292/163
5,806,900 A * 9/1998 Bratcher et al. ..... 292/137
6,848,728 B2 * 2/2005 Rotondi et al. ..... 292/336
7,007,524 B2 * 3/2006 Jasper ..... 70/92
7,407,199 B2 * 8/2008 Richardson ..... 292/163
8,333,413 B2 * 12/2012 Bourgoin et al. ..... 292/164
8,414,039 B2 * 4/2013 Liang et al. ..... 292/240
2005/0127689 A1 * 6/2005 Tang ..... 292/288
2005/0146143 A1 * 7/2005 Lutfallah ..... 292/153
2007/0194578 A1 * 8/2007 Boosey et al. ..... 292/251.5
2008/0129054 A1 * 6/2008 Tremble et al. ..... 292/33
2010/0117378 A1 * 5/2010 Seo et al. ..... 292/163

* cited by examiner

*Primary Examiner* — Carlos Lugo
*Assistant Examiner* — Faria Ahmad
(74) *Attorney, Agent, or Firm* — DeLio, Peterson & Curcio, LLC

(57) ABSTRACT

The invention relates to a window lock having a trigger and a bolt, the trigger being rotatable about an axis of rotation and the bolt being movable from a locked position to an unlocked position. The bolt also includes a first clip and a second clip and the trigger includes a stop and a ramp. The trigger rotates about the axis for engaging and disengaging the ramp and the stop with the first and second clips for moving the bolt between the locked and unlocked positions. The invention further relates to a window lock that automatically locks without user intervention.

19 Claims, 7 Drawing Sheets

WINDOW LOCK

CROSS REFERENCED TO RELATED APPLICATION

This patent application claims priority to and the benefit of U.S. Provisional Patent Application No. 61/169,826 filed Apr. 16, 2009, titled "Window Lock," which is incorporated herein by reference in its entirety.

FIELD OF THE INVENTION

The invention relates to a lock mechanism for a window assembly.

BACKGROUND OF THE INVENTION

A double-hung, single hung, and double slider window assembly typically includes a window frame and a pair of window sashes mounted for vertical reciprocal sliding movement, one relative to the other, in guide rails of the master frame jamb of the window assembly.

A traditional lock mechanism of the prior art, for a double hung window assembly usually includes one part of the lock on one sash and another part of the lock on the other sash, wherein joining the two parts of the lock mechanism together results in locking the sashes to one another.

One disadvantage of this type of lock mechanism is that it normally requires the sashes be a certain distance away from one another. When the sashes are too close to one another or too far apart the lock mechanism may be ineffective. For example, if the sashes are spaced too far apart, the two parts of the lock mechanism may not be able to be joined together and the window sashes may not be locked. If the sashes are too close to one another, the parts of the lock mechanism may bind or interfere with one another, resulting in the parts not being able to mate together and therefore the window sashes may not be locked. When these problems occur during installation, the installer must adjust the window sashes and lock mechanism, numerous times, before achieving a proper fit between the sashes and lock mechanism. These problems may also occur over time when windows become old, warped, or damaged through normal wear and tear.

As a result of the foregoing disadvantage, the lock mechanism and/or window sashes may need to be replaced without any assurance that the problems will not reoccur. In addition, forcibly pushing the sashes together in order to bring them to a proper distance may result in stress upon the frame around the sashes and/or the glass panes. Continuing to use the lock mechanism and window sashes in this fashion can exacerbate the problems.

What is desired, therefore, is a window lock that is more flexible to use than traditional lock mechanisms. Another desire is to provide a window lock that accommodates changes in the spacing between the sashes. A further desire is to provide a window lock that is more resistant to damage than the traditional locking mechanism without sacrificing reliability. Yet another desire is to provide a window lock that works for sashes that have a varying distance between them. Another desire is to provide a window lock that automatically locks the sashes when they are brought together.

SUMMARY OF INVENTION

It is therefore an object of the invention to provide a window lock that overcomes the above described disadvantages of the prior art.

Another object is to provide a window lock that functions properly when encountering variances in the spacing between the sashes.

A further object is to provide a window lock that automatically locks the window sashes without user intervention.

These and other objects are achieved by providing a window lock mechanism having a trigger and a bolt, the trigger being rotatable about an axis and the bolt being movable from a locked position to an unlocked position. The bolt includes a first clip and a second clip and the trigger includes a stop and a ramp. The trigger rotates about the axis for engaging and disengaging the ramp and the stop with the first and second clips which move the bolt between the locked and unlocked positions.

In some embodiments, the first and second clips are positioned on a beam and the beam cantilevers from the bolt.

In some embodiments, the trigger includes at least one axle for rotation about an axis. In other embodiments, the first and second clips and the stop are located between a first axle and a second axle.

In another embodiment, the trigger further includes a ramp for engaging the first clip to inhibit movement of the bolt and holding the bolt in a first unlocked position. In other embodiments, the stop engages with the second clip for holding the bolt in a second unlocked position. In some of these embodiments, the stop rotates about a pivot point toward the beam for engaging with the second clip.

In a further embodiment, a first distance is defined by movement of the bolt from the locked position to the unlocked position and a second distance is defined by movement of the bolt from the first to second unlocked positions. The second distance is less than the first distance.

In yet another embodiment, engagement of the trigger with a strike causes the stop to rotate about the axis and disengage from the second clip, wherein disengagement permits a bolt spring to bias the bolt toward the locked position.

In one case, the ramp engages a top surface of the first clip for flexing the beam relative to the bolt thus allowing the stop to disengage from and pass over the second clip. In another case, the beam flexes about a pivot point at the juncture of the bolt and the beam.

In another aspect of the invention, the window lock includes a trigger and a bolt. The trigger is rotatable about an axis and has a stopper selected from the group consisting of a stop, a ramp, and combinations thereof. The bolt is movable from a locked position to an unlocked position and has a clip. The trigger rotates about the axis for engaging and disengaging the stopper with the clip for moving the bolt between the locked and unlocked positions.

In a further aspect of the invention, a method for locking and unlocking a window lock includes the steps of providing a trigger with a stop and a ramp, providing a bolt with a first clip and a second clip, the bolt is movable between a locked position and an unlocked position. The method also includes engaging and disengaging the ramp and the stop with the first clip and the second clip for locking and unlocking the window lock.

In some embodiments, the method rotates the trigger about an axis of rotation for causing the ramp to engage with the first clip for holding the bolt in the first unlocked position.

In other embodiments, the method rotates the trigger about the axis for causing the ramp to disengage from the first clip, thereby permitting the bolt to move from the first unlocked position toward the locked position; and causing the stop to engage with the second clip for holding the bolt in the second unlocked position.

In further embodiments, the method causes the trigger to rotate about the axis for disengaging the stop from the second unlocked position, thereby permitting the bolt to move from the second unlocked position toward the locked position.

In another aspect of the invention, a method for locking and unlocking a sliding window includes the steps of providing a window having two sashes that are slideable relative to each other in parallel planes; and providing a bolt on a first sash, the bolt being movable between a locked and two unlocked positions. The method also moves the bolt a first distance away from the second sash to a first unlocked position, whereby the first sash is slideable with respect to the second sash. The method also includes the step of moving the first sash with respect to the second sash, whereby the bolt moves a second distance to a second unlocked position, the second distance being less than the first distance.

In some embodiments, the method moves the first sash with respect to the second sash, whereby the bolt moves towards the second sash to the locked position, automatically locking the window.

DETAILED DESCRIPTION OF THE INVENTION

Figure 1:
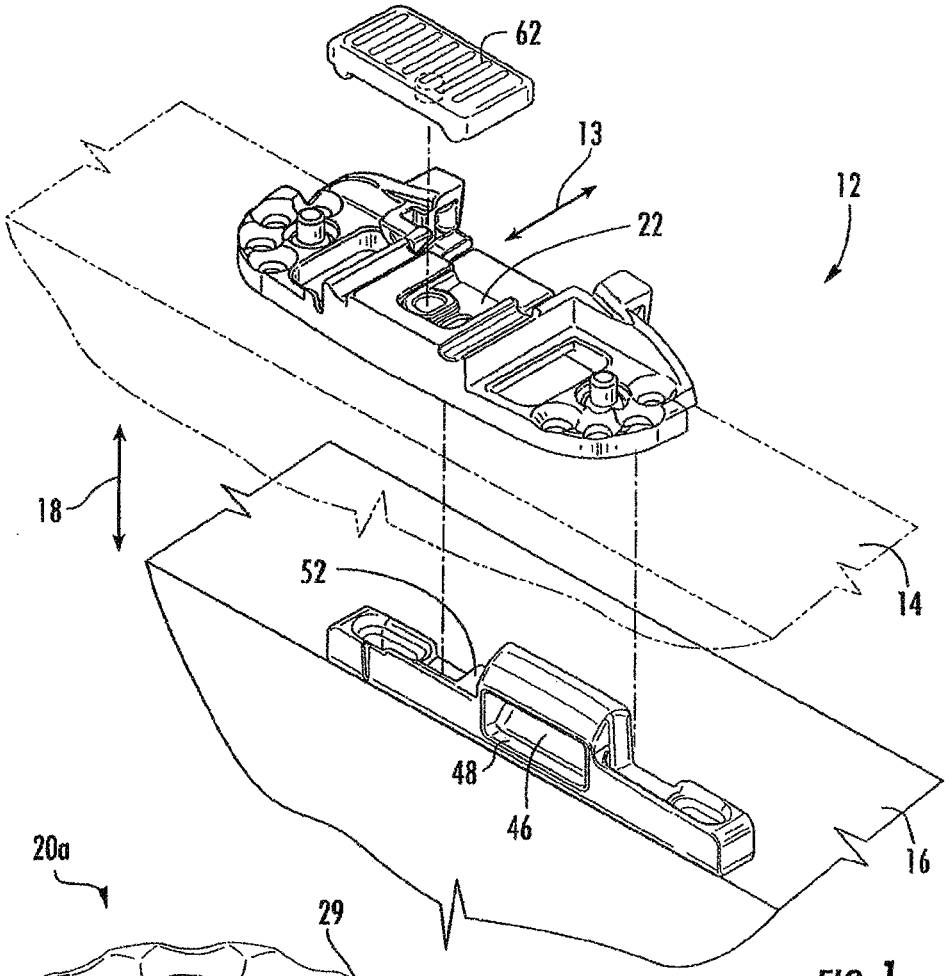
FIG. 1 depicts an isometric view of an embodiment of the window lock in accordance with the invention.

As shown in FIGS. 1, 2A, 2B, 4, and 5, window assembly 12 includes sashes 14, 16 that slide in parallel planes relative to one another in the direction of arrows 18, either vertically or horizontally. In the example used in the drawings, a vertically sliding window sash assembly is shown. (References to direction or movement up or down are with respect to the vertically sliding window sash example; for horizontally sliding window sashes these directions refer to right or left.) A lock 20 is attached to the adjacent sash portions 14 and 16 and includes a bolt 22 and a trigger 24 on a first lock portion 20*a* mounted on sash 14. Bolt 22 includes a first clip 26, a second clip 28, a beam 30, and pivot point 32 and where trigger 24 includes stop 34, axle 36, and ramp 38. Depending on the position of trigger 24 (explained below), bolt 22 moves in a direction normal to the planes of the sashes in direction of arrows 13, toward and away from sash 16. A second lock portion 20*b* is mounted on sash 16 and includes a strike 44 having an orifice 46 that may receive the end of bolt 22 to lock the sashes from relative sliding movement.

The positions of bolt 22 and trigger 24 relative to each other enable bolt 22 to lock and unlock sliding movement of the sashes 14 and 16. More particularly, the engagement or disengagement of ramp 38 with first clip 26 holds or releases bolt 22 from a first unlocked position at a spaced distance away from strike 44 to permit opening of the window. The engagement or disengagement of stop 34 with second clip 28 holds or releases bolt 22 from a second unlocked position, which is closer to strike 44 but still spaced to permit relative sliding movement of the sashes. Where bolt 22 is not held in the first or second unlocked position, bolt 22 is permitted to pass to the locked position where it is engaged with orifice 46 of strike 44 to restrict sash movement and lock the window.

As shown in FIGS. 7-14, the invention generally includes the following steps to operate the lock while opening and closing the window: window closed and locked (bolt engaged with strike); window closed but unlocked (bolt moved away from strike and not engaged); window open and unlocked (trigger begins to rotate due to spring bias); window open and unlocked (trigger rotation complete due to spring bias); and window closed and trigger about to release bolt, permitting bolt to return to locked position shown in first step. As shown and described herein and in FIGS. 3 and 7-14, trigger 24 rotates about axis of rotation R for engaging and disengaging ramp 38 and stop 34 with first and second clips 26, 28, respectively, for moving bolt 22 between the locked and unlocked positions.

Figure 7:
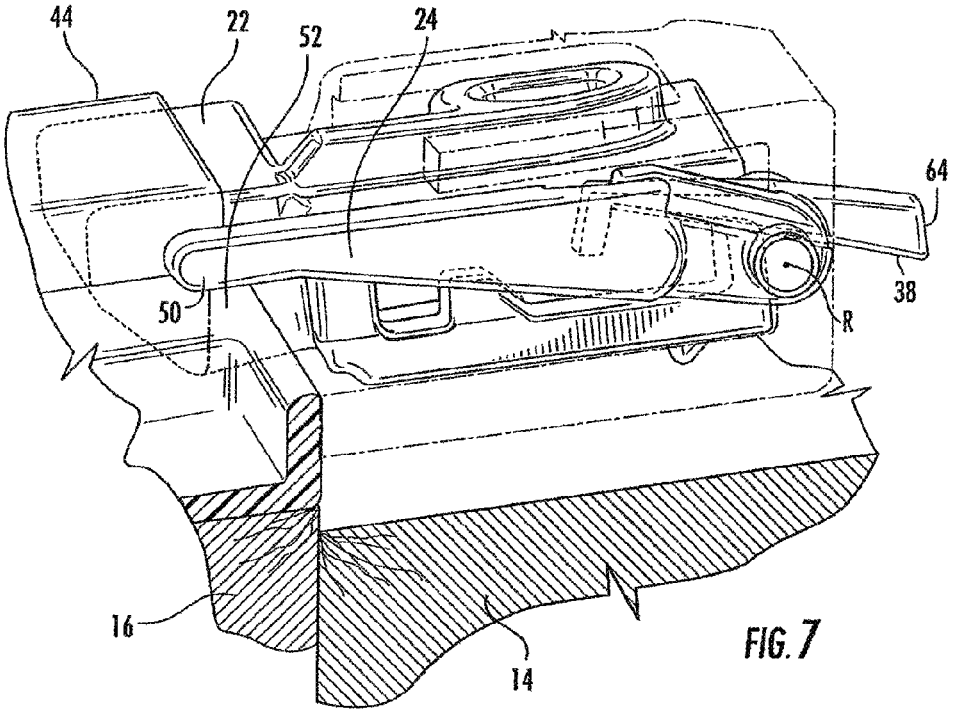
FIG. 7 depicts an isometric view of the trigger and bolt shown in FIG. 1, where the trigger and bolt are in a locked position with the window closed.

When the window is closed and locked, as shown in FIG. 7, bolt 22 is in the locked position and engaged with strike 44 by extending into orifice 46, wherein window 12 is inhibited from opening because bolt 22 would come in contact with edge 48 of strike 44. Tip 50 of trigger 24 is in contact with plateau 52 of strike 44.

The locked position shows that bolt 22 is in the left position while trigger 24 is inhibited from further rotation in the counterclockwise position because of physical contact with plateau 52, wherein further counterclockwise rotation is possible if trigger 24 were moved away from plateau 52. In the orientation shown in FIGS. 7-14, bolt 22 is permitted to move left (locked position) to right (unlocked positions), and vice versa. Trigger 24 is permitted to rotate about axis of rotation R but does not translate or move left, right, up, or down unless such movement is associated with the rotation and/or because bolt 22 is moving left or right. Bolt spring 54 biases bolt 22 toward the locked position and trigger spring 56 biases trigger 24 in a counterclockwise rotational direction.

Trigger 24 rotates clockwise or counterclockwise about axis of rotation R and does not itself move in any linear direction, such as left, right, up, or down. In some embodiments shown in FIGS. 3 and 5, axle 36 is divided into two separate axles 36*a*, 36*b* that are placed in hole 58 and clip 60, both of which are mounted on chassis 23.

Figure 3:
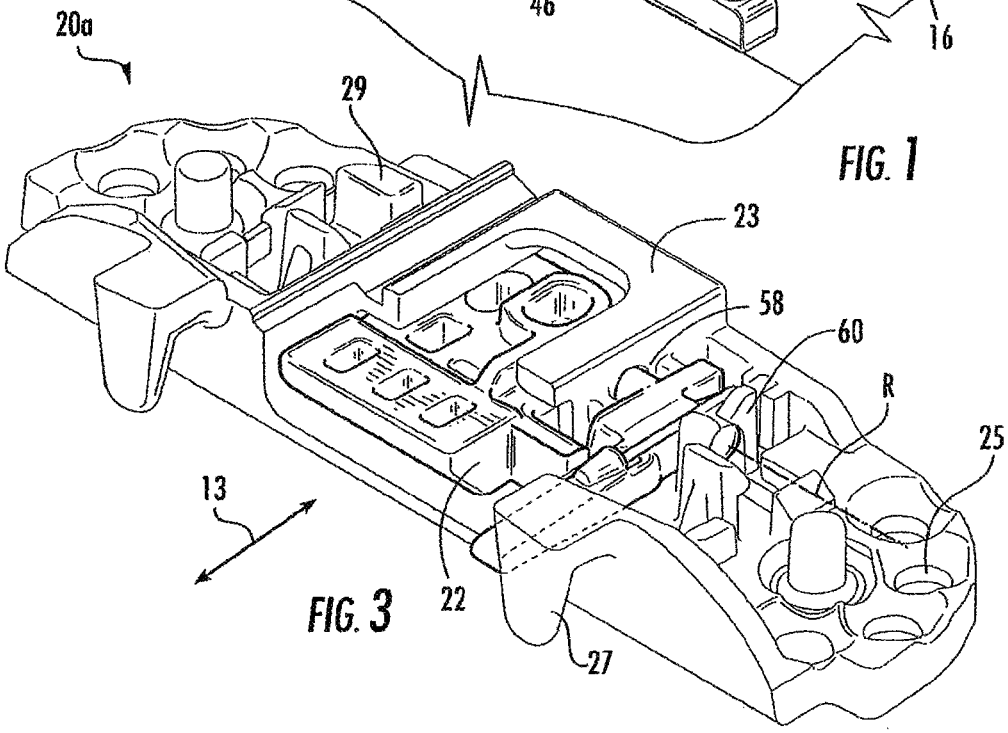
FIG. 3 depicts an isometric view of the window lock without the cover shown in FIG. 1.
Figure 2A:
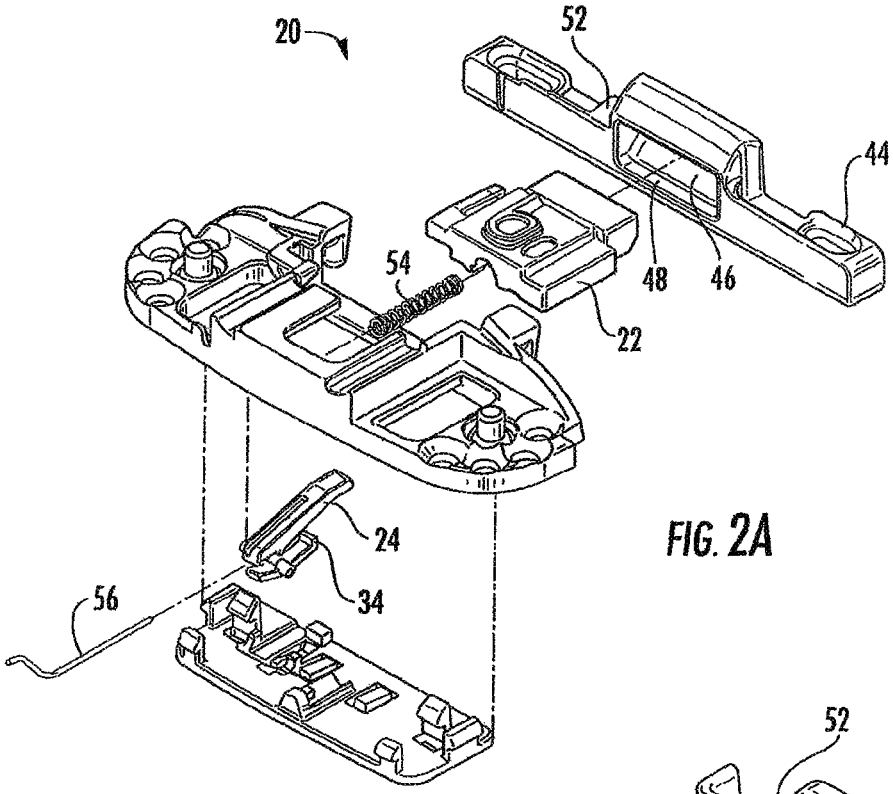
FIG. 2A depicts an exploded view of the window lock shown in FIG. 1.
Figure 2B:
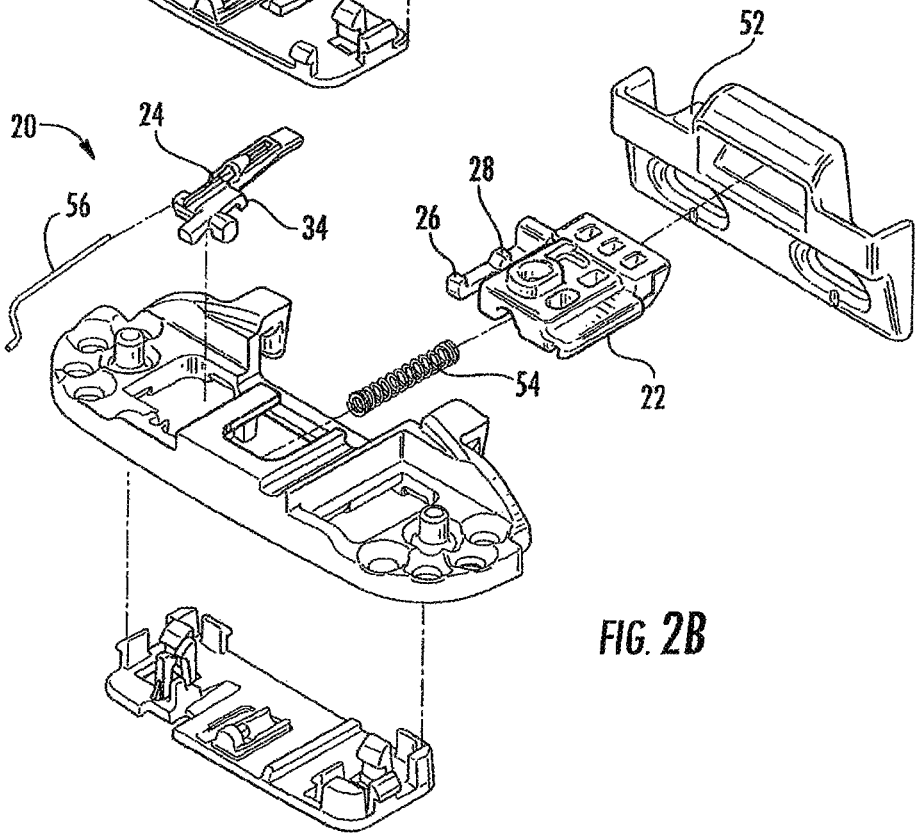
FIG. 2B depicts an exploded view of another embodiment of the window lock shown in FIG. 1.
Figure 4:
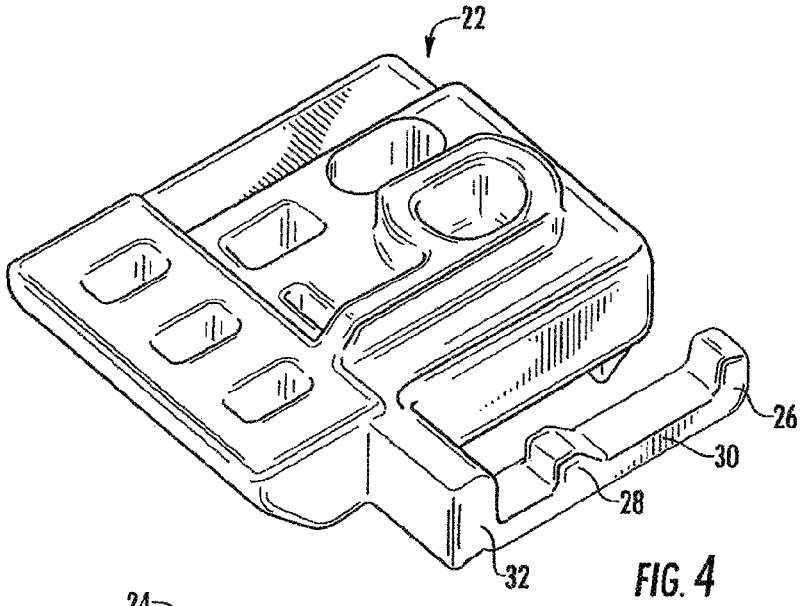
FIG. 4 depicts an isometric view of the bolt shown in FIG. 1.
Figure 5:
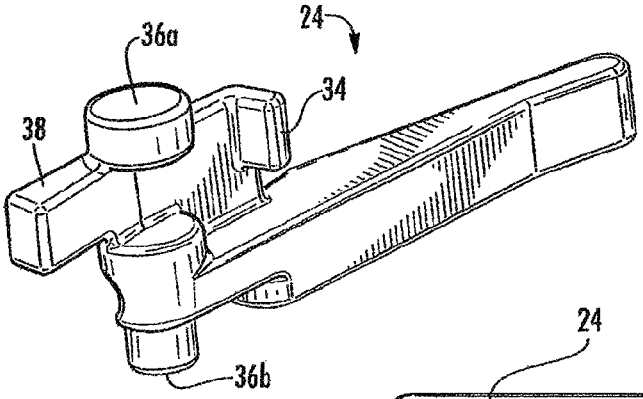
FIG. 5 depicts an isometric view of the trigger shown in FIG. 1.
Figure 6:
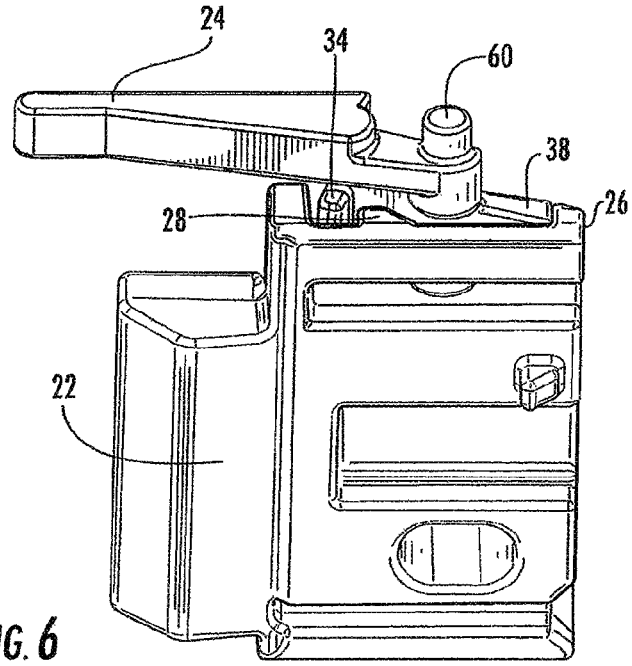
FIG. 6 depicts a bottom view of the trigger and bolt shown in FIG. 1.

As shown in FIG. 3, chassis 23 includes a plurality of studs 29 and orifices 25 for mounting other structure, such as clip 60, bolt 22, and trigger 24. In addition, chassis 23 includes grips 27 for absorbing stress from window sashes 14, 16 being locked and unlocked together.

As shown in FIGS. 3-6, axles 36*a*, 36*b* together rotate about axis R and first clip 26, second clip 28, stop 34, ramp 38, and beam 30 are all located between axles 36*a*, 36*b*. In this fashion, movement of bolt 22 does not interfere with axle 36, and vice versa, which means the left or right movement of the bolt does not cause any part of bolt 22 to hinder rotation of axle 36. Therefore, trigger 24, including stop 34 and ramp 38, does not affect the movement of bolt 22 except when engaged with first or second clips 26, 28.

To unlock window 12, a user moves a finished handle or button 62 to the unlocked position, where the handle or button is connected to bolt 22. When bolt 22 is initially moved to the unlocked positions (right direction) shown in FIG. 8, the window is still in the closed position, in which case tip 50 of trigger 24 is still in contact with plateau 52. In this position, bolt 22 is moved toward the right, away from strike 44, resulting in the window being permitted to open.

Figure 8:
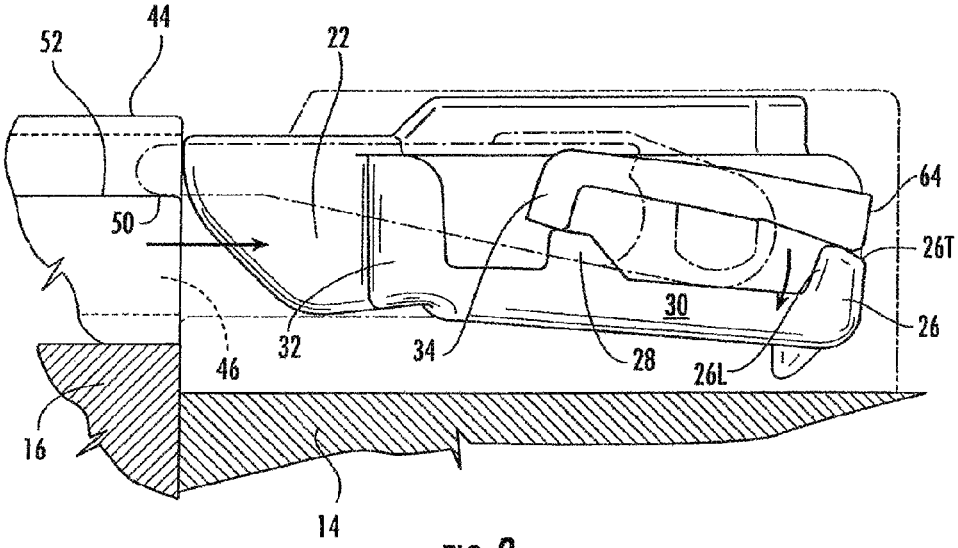
FIG. 8 depicts a side view of the trigger and bolt shown in FIG. 1, where the bolt is moving toward an unlocked position and the window is closed.
Figure 9:
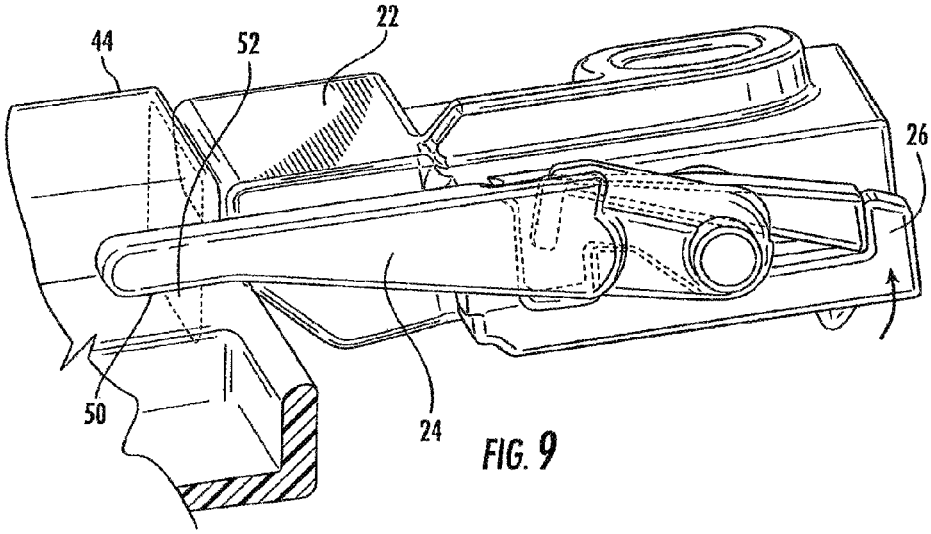
FIG. 9 depicts an isometric view of the trigger and bolt shown in FIG. 1, where the bolt is in an unlocked position and the window is closed.
Figure 10:
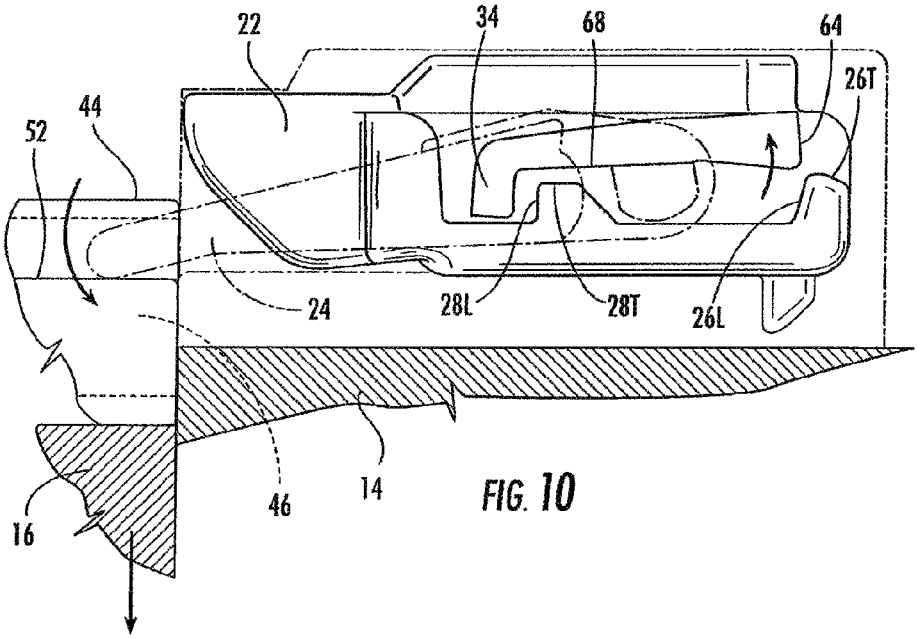
FIG. 10 depicts a side view of the trigger and bolt shown in FIG. 1, where the trigger and bolt are in an unlocked position and the window is just opened.

As shown from FIG. 7 to FIG. 9, top surface 26T of first clip 26 slides along ramp 38 until top surface 26T passes over butt 64, resulting in ramp 38 engaging with left side 26L of first clip 26. In this position, butt 64 holds bolt 22 in a first unlocked position and inhibits bolt spring 54 from biasing bolt 22 toward the locked position (left position). Concurrently, second clip 28 passes under stop 34 without right side 28R of second clip 28 coming in contact with stop 34 because of contact between ramp 38 with top surface 28T and contact between tip 50 with plateau 52.

When ramp 38 slides along top surface 28T, the gradually increasing thickness or downward sloping decline of ramp 38 causes beam 30 to flex or pivot about pivot point 32 (see FIG. 8 for beam 30 rotating downwardly or clockwise about pivot point 32). When butt 64 or ramp 38 completes its pass over top surface 28T, beam 30 flexes or pivots up (see FIG. 9 for beam 30 rotating upwardly or counterclockwise about pivot point 32). Once rotated upward, left side 26L engages butt 64.

Figure 11:
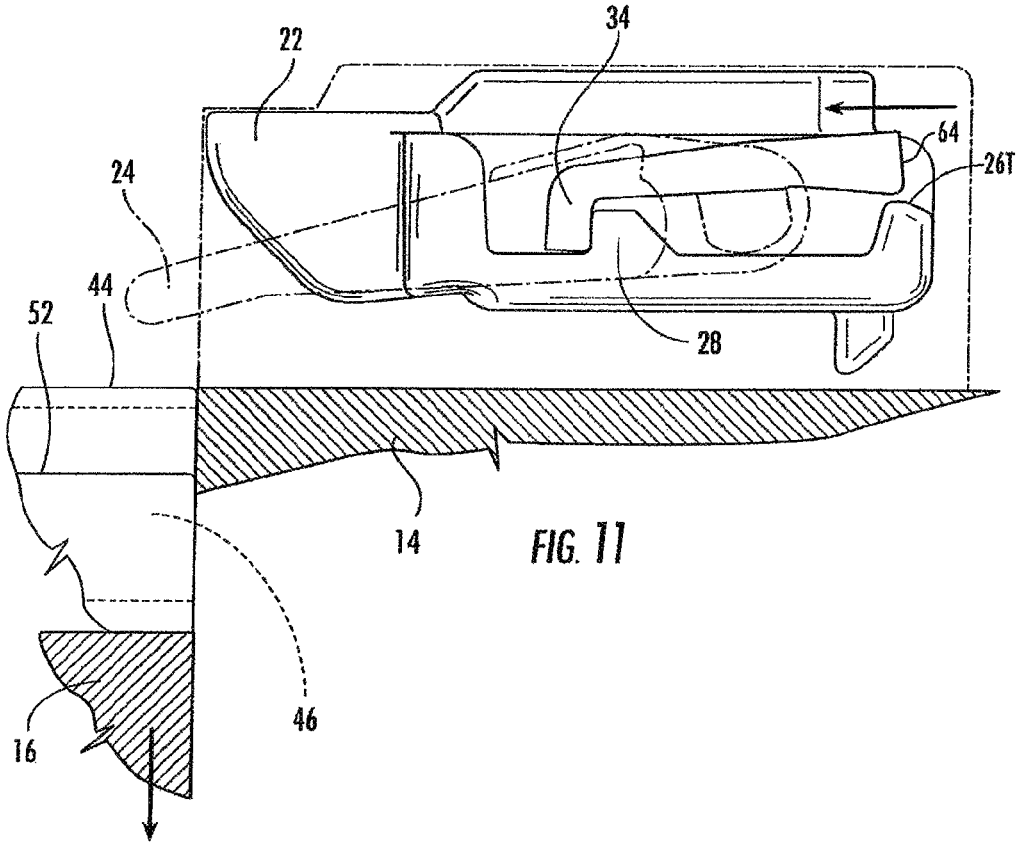
FIG. 11 depicts a side view of the trigger and bolt shown in FIG. 1, where the trigger and bolt are in an unlocked position and the window is fully opened.

In a next step, the user opens window by moving sashes 14, 16 to slide them relative to each other. As a result and in reference to FIG. 10, tip 50 moves away from plateau 52 and this allows trigger spring 56 to bias trigger 24 in a counterclockwise direction until belly 68 of trigger 24 contacts top surface 28T of second clip 28. During the counterclockwise rotation, butt 64 disengages from left side 26L of first clip 26, which releases bolt 22 from the first unlocked position and allows bolt spring 54 to bias bolt 22 toward the locked position (left position and bolt 22 moving leftwards shown in FIG. 11). However, because of the counterclockwise rotation of trigger 24, stop 34 engages with left side 28L of second clip 28 before bolt 22 biases leftwards any further (as shown in FIG. 11), wherein bolt 22 biases a relatively modest or small distance after butt 64 disengages from left side 26L of first clip 26. Due to the small leftward movement of bolt 22 when ramp 38 or butt 64 disengages from left side 26L and when stop 34 engages with left side 26L, at least a part of first clip 26 and at least a part of top surface 26T are moved under ramp 38. See FIG. 11. When stop 34 engages with left side 28L of second clip 28, bolt 22 is held in the second unlocked position. As shown, the modest or small distance bolt 22 moves from the first unlocked position to the second unlocked position is less than a distance bolt 22 moves from the locked position shown in FIG. 7 to the first unlocked position.

Figure 12:
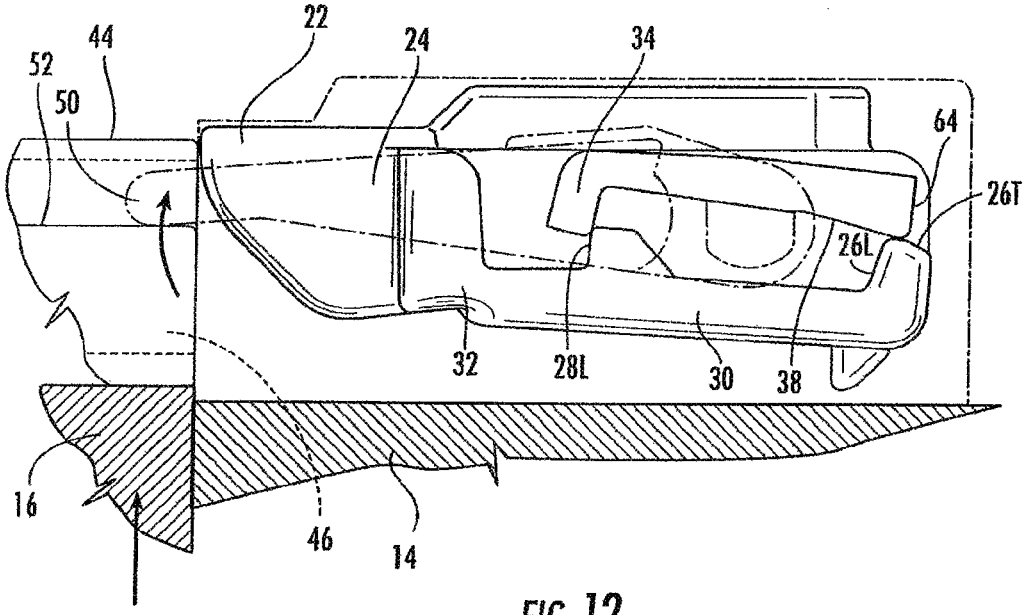
FIG. 12 depicts a side view of the trigger and bolt shown in FIG. 1, where the window is just closed and trigger is moving toward a locked position and the bolt is still in an unlocked position.

In a next step shown in FIG. 12, lock 20 automatically locks window assembly 12 when sashes 14, 16 are brought together without user intervention. More particularly, as window 12 approaches a closed position (almost closed), tip 50 comes in contact with plateau 52 and causes trigger 24 to rotate clockwise about axis R as window continues to close. As trigger 24 rotates clockwise, ramp 38 comes in contact with top surface 26T and, because of this, butt 64 does not engage or contact left side 26L, which would hinder bolt 22 from moving to the locked position. As trigger 24 rotates clockwise, stop 34 disengages, or rotates upward, away from left side 28L of second clip 28. Because stop 34 is no longer holding bolt 22 in the secondary locked position (FIG. 13), bolt spring 54 is permitted to bias bolt 22 to the locked or left most position (FIG. 14), thereby locking lock 20 and window 12 automatically without user intervention.

Referring again to FIG. 12, because tip 50 is in contact with plateau 52 and ramp 38 is in contact with top surface 26T, stop 34 does not engage with second clip 28 as bolt 22 moves leftward to the locked position. Therefore, as bolt 22 moves to the locked position, ramp 38 slides along top surface 26T and stop 34 passes over second clip 28. Once stop 34 passes over second clip 28, the invention is in the position shown in FIG. 7.

Figure 13:
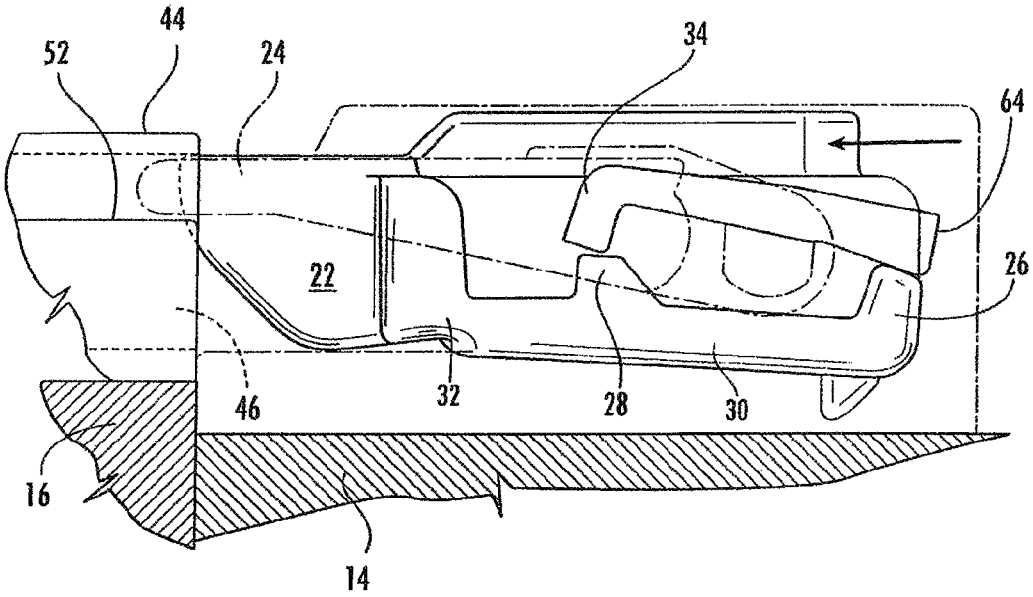
FIG. 13 depicts a side view of the trigger and bolt shown in FIG. 1, where the window is closed and the bolt is automatically moving toward the locked position.
Figure 14:
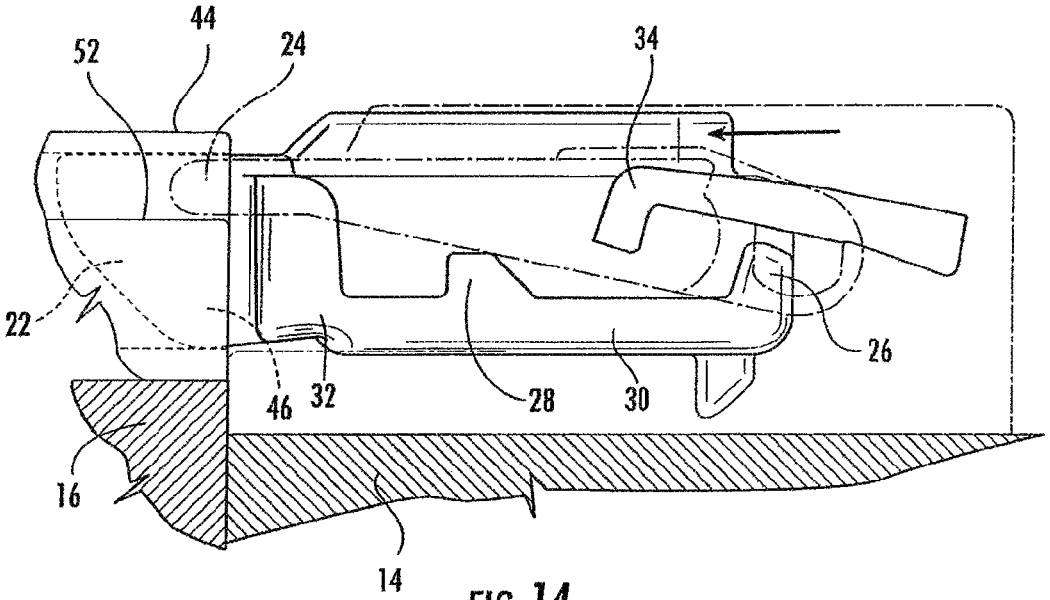
FIG. 14 depicts a side view of the trigger and bolt shown in FIG. 1, where the trigger and bolt are resetting to the locked position shown in FIG. 7.

In some embodiments, the clockwise rotation of trigger 24 causes ramp 38 to not only slide along top surface 26T but also presses down upon top surface 26T, which causes beam 30 to flex downward or away from trigger 24 at pivot point 32 (FIGS. 12 and 13). In some of these embodiments, once stop 34 passes over second clip 28, beam 30 flexes back (FIG. 14) to its original position shown in FIG. 7. In other embodiments, beam 30 cantilevers from pivot point 32 located on bolt 22.

In a further embodiment, stop 34 engages and disengages with second clip 28 in alternating fashion, or alternately, as ramp 38 engages and disengages with first clip 26. In other words, to the extent bolt 22 is in any unlocked position or to the extent bolt 22 is approaching or being released from any unlocked position shown in FIGS. 7-14, if stop 34 is engaged with second clip 28, ramp 38 is disengaged from first clip 26. Moreover, to the extent bolt 22 is in any unlocked position or to the extent bolt 22 is approaching or being released from any unlocked position shown in FIGS. 7-14, if stop 34 is disengaged with second clip 28, ramp 38 is engaged with first clip 26.

In another embodiment, stop 34 engages with and disengages from a single clip, whether it be first clip 26, second clip 28, or another clip centrally located between first and second clips. In this embodiment, ramp 38 does not engage or disengage with any part of bolt 22, including first clip 26. In these embodiments, the invention is effectively reduced to a single clip and stop 34 engages and disengages from one another to lock and unlock window assembly 12 by holding bolt 22 in the locked position and releasing bolt 22 so that bolt spring 54 can bias bolt 22 to the unlocked position.

In other embodiments, ramp 38 engages with the single clip as described above and stop 34 is not engaging or disengaging with any part of bolt 22. In these embodiments, the invention is effectively reduced to the single clip and ramp 38 that engage and disengage from one another to lock and unlock window assembly 12 by holding bolt 22 in the locked position and releasing bolt 22 so that bolt spring 54 can bias bolt 22 to the unlocked position.

In some of these embodiments, trigger 24 has a stopper for engaging with bolt 22, wherein the stopper is selected from the group consisting of stop 34, ramp 38, and combinations thereof.

It is understood that the above described invention properly operates in either one of two orientations of trigger 24 and beam 30 and the corresponding clips on beam 30. In one embodiment, shown in FIG. 2A, stop 34 and ramp 38 are facing in an upward direction and clips 26, 28 are facing in a downward direction. In another embodiment shown in FIG. 2B, stop 34 and ramp 38 are facing in a downward direction and clips 26, 28 are facing in an upward direction. Lock 20 locks and unlocks as described herein with trigger 24 and bolt 22 positioned in either one of the embodiments shown in FIG. 2A or 2B.

The example described in the drawings is of a window having the sashes move in the vertical or horizontal direction. The window lock described herein may be likewise employed for sliding doors that move in the horizontal direction (or any other relative direction), wherein the lock described herein may be employed to lock an edge of a sliding door with respect to a door jamb or adjacent door. In such case the term window is to be understood to encompass such sliding doors and the term sash is to be understood to encompass such door edges and jambs as well.

Thus, the present invention provides one or more of the following advantages: 1) more flexibility of use than a traditional lock; 2) accommodates changes in the spacing between the sashes; 3) more resistant to damage than a traditional lock without sacrificing reliability; 4) works for sashes that have a varying distance between them; and/or 5) automatically locks the window when the sashes are brought together.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A window lock for a window, comprising:

a trigger, a bolt and a finished handle connected to the bolt, said trigger having a tip and sides extending on opposite sides of an axis, and said trigger being rotatable about the axis;

said bolt and finished handle being movable from a locked position to an unlocked position to lock and unlock said window;

said bolt having a first clip and a second clip;

said trigger having a stop on one side of said axis and a ramp on the other opposite side of said axis;

said trigger rotating clockwise or counterclockwise about said axis for engaging and disengaging said ramp and said stop with said first and second clips thus moving said bolt between the locked and unlocked positions, wherein said first and second clips and said stop are located between a first axle and a second axle.

2. The window lock according to claim 1, wherein said first and second clips are positioned on a beam, said beam cantilevering from said bolt.

3. The window lock according to claim 1, wherein said trigger includes said first axle and said second axle for rotation about said axis.

4. The window lock according to claim 1, wherein said ramp engages with said first clip for holding said bolt in a first unlocked position.

5. The window lock according to claim 4, wherein said stop engages with said second clip for holding said bolt in a second unlocked position.

6. The window lock according to claim 5, wherein a first distance is defined by the length of the movement of said bolt from the locked position to the first unlocked position.

7. The window lock according to claim 6, wherein a second distance is defined by length of movement of said bolt from the first unlocked position to the second unlocked position, and wherein said second distance is less than said first distance.

8. The window lock according to claim 5, wherein said stop rotates about said axis for engaging with said second clip.

9. The window lock according to claim 1, wherein engagement of said trigger with a strike causes said stop to rotate about said axis and disengage from said second clip, and wherein disengagement permits a bolt spring to bias said bolt toward said locked position.

10. The window lock according to claim 1, wherein said ramp engages a top surface of said first clip for flexing a beam relative to said bolt for allowing said stop to disengage from and pass over said second clip.

11. The window lock according to claim 2, wherein said beam flexes about a pivot point at a juncture of said bolt and said beam.

12. The window lock according to claim 1, further including a strike having an orifice for receiving the bolt, the bolt being moveable a first distance from the locked position to the first unlocked position, the trigger being engageable with the strike to move the bolt a second distance to a second unlocked position, the second distance being less than the first distance.

13. The window lock according to claim 1, wherein said axis is between said first and second clips.

14. A window lock, comprising:

a trigger, a bolt and a finished handle connected to the bolt, said trigger having sides extending on opposite sides of an axis, and said trigger being rotatable about the axis;

said bolt and finished handle being movable from a locked position to an unlocked position;

said bolt having a clip;

said trigger having a stop disposed on one side of the axis, and a ramp disposed on the other opposite side of the axis;

said trigger having a tip that when moved initiates rotation of said trigger about said axis;

said trigger rotating about said axis for engaging and disengaging said stop and ramp with said clip thus moving said bolt between the locked and unlocked positions; and a strike having an orifice for receiving the bolt, the bolt being moveable a first distance from the locked position to a first unlocked position, the trigger being engageable with the strike to move the bolt a second distance to a second unlocked position, the second distance being less than the first distance.

15. A method for locking and unlocking window sashes, comprising the steps of:

mounting two window sashes relative to each other in generally parallel planes;

installing a bolt that is connected to a finished handle and having at least a first clip, and installing a trigger having a stop and a ramp on a first sash, the trigger having a tip and sides extending on opposite sides of an axis and being rotatable about the axis with the stop being disposed on one side of the axis and the ramp being disposed on the other opposite side of the axis, the bolt being movable between a locked and two unlocked positions;

moving the bolt a first distance away from the second sash to engage the end of the trigger having the ramp with the at least first clip and hold the bolt in a first unlocked position, whereby the first sash is slideable with respect to the second sash;

moving the first sash with respect to the second sash and engage the end of the trigger having the stop with the at least first clip, whereby the bolt moves a second distance to a second unlocked position, the second distance being less than the first distance.

16. The method according to claim 15, further comprising the step of moving the first sash with respect to the second sash, whereby the bolt moves towards the second sash to the locked position, automatically locking the window.

17. The method according to claim 15 wherein the bolt has a first clip and a second clip, and wherein the trigger rotates clockwise or counterclockwise about the axis to engage and disengage the ramp with the first clip and the stop with the second clip thus moving said bolt between the first locked and second unlocked positions.

18. The method according to claim 17, wherein the first and second clips are positioned on a beam, the beam cantilevering from the bolt.

19. The method according to claim 18, wherein said ramp engages a top surface of said first clip for flexing a beam relative to said bolt for allowing said stop to disengage from and pass over said second clip.

* * * * *